United States Patent [19]

Turner

[11] 4,226,346

[45] Oct. 7, 1980

[54] COMPACT FOLDABLE BOOTJACK WITH POSITIVE LOCKING DEVICE

[76] Inventor: Posie C. Turner, 815 57th Pl. NE., Fairmount Heights, Md. 20027

[21] Appl. No.: 25,519

[22] Filed: Mar. 30, 1979

[51] Int. Cl.[3] ..... A47J 51/02

[52] U.S. Cl. ..... 223/115

[58] Field of Search ..... 223/115, 114, 113, 116, 223/117

[56] References Cited

U.S. PATENT DOCUMENTS

| | | | |
|---|---|---|---|
| 190,508 | 5/1877 | Niver | 223/115 |
| 275,551 | 4/1883 | Walker | 223/115 |
| 1,893,280 | 1/1933 | Gerfen | 223/115 |

FOREIGN PATENT DOCUMENTS

| | | | |
|---|---|---|---|
| 257985 | 4/1949 | Switzerland | 223/115 |

*Primary Examiner*—Werner H. Schroeder
*Assistant Examiner*—Andrew M. Falik
*Attorney, Agent, or Firm*—Sughrue, Rothwell, Mion, Zinn and Macpeak

[57] ABSTRACT

A bootjack having a front part with a V-shaped opening at one end is hinge connected at its opposite end to the abutting end of a rear part. The parts are pivoted into the bottom face folded position for ease in transport and storage. A bifurcated leg is hinged to the front part forwardly of the hinge connection between the two parts and a bifurcated latch yoke is hinged at one end to the leg, just above the contact point with the underlying support surface when in unfolded and locked position, and is hinged at its opposite end to the rear part beyond the hinge joint between the two parts. This forms a right angle positive latch for the leg which is pivoted to a position where it is generally perpendicular to the front part when the bootjack is in extended position for rigidifying the assembly and supporting the same in upwardly inclined position with respect to the underlying support surface. A rubber stop on the outboard end of the hinged rear part acts as a brake resisting movement of the boot and the stop moves into the gap between the bifurcated latch yoke and leg when the front and rear parts are folded against each other.

2 Claims, 5 Drawing Figures

FIG. 1
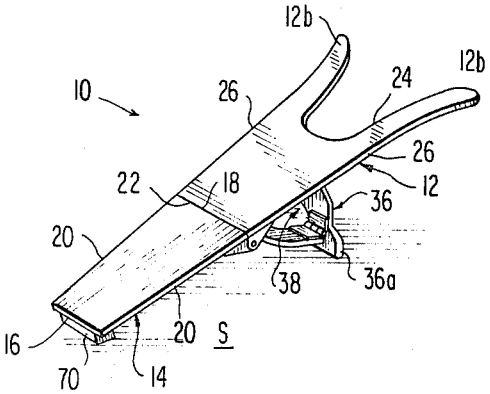
FIG. 2
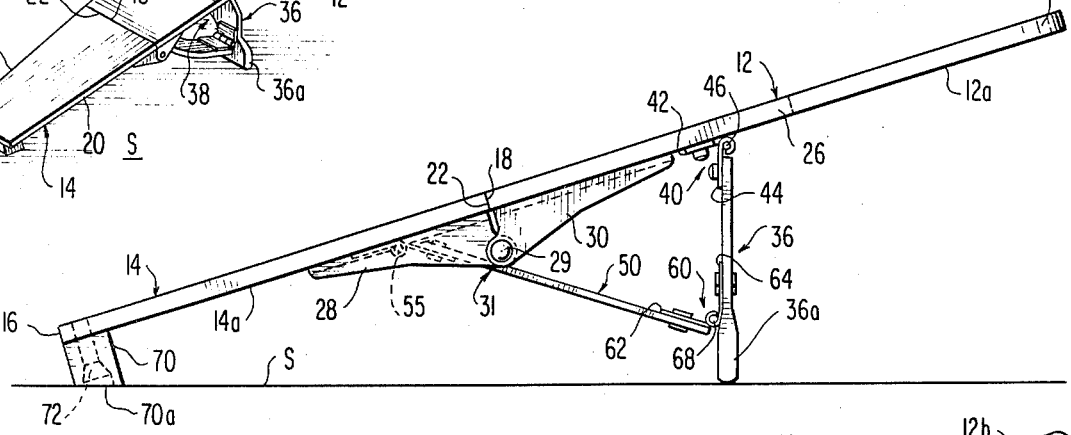
FIG. 3
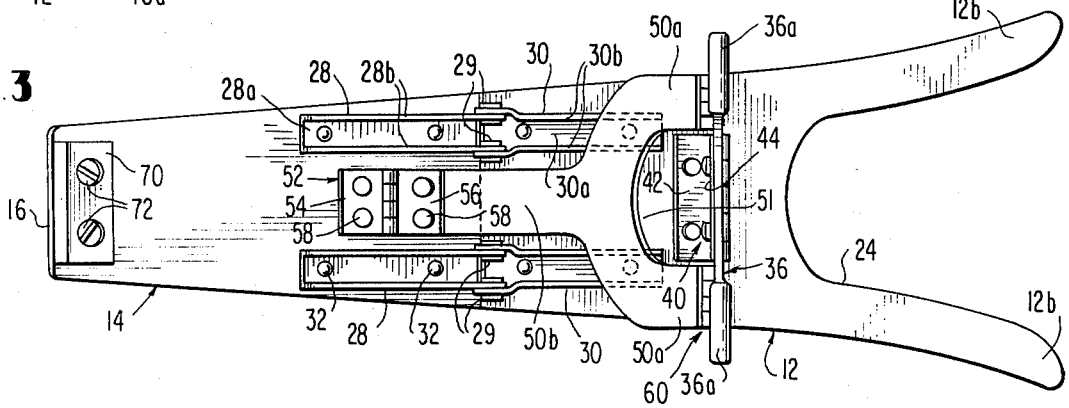
FIG. 4
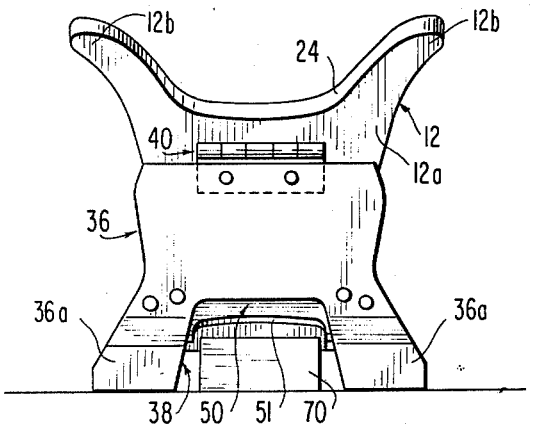
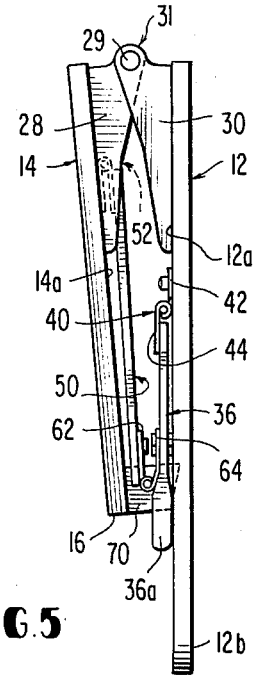
FIG. 5

COMPACT FOLDABLE BOOTJACK WITH POSITIVE LOCKING DEVICE

FIELD OF THE INVENTION

This invention relates to foldable bootjacks and more particularly to a compact foldable bootjack which is positively locked in extended position to resist breakage during use.

Bootjacks have been constructed of hinged front and rear parts or members which may be folded against each other when not in use for storage and transport. One such bootjack is the subject matter of U.S. Pat. No. 1,893,280 to Roye P. Gerfen issuing Jan. 3, 1933. The foldable bootjack of this patent is characterized by a front part bearing a V notch within its outboard end and being pivotably connected to the rear part or member by a hinge construction which incorporates a coil spring to bias the two parts or members into an in-line or extended position. Also incorporated within the hinge joint is a leg which extends generally at right angles to the plane defined by the front and rear parts when in extended position to cause the bootjack to take an inclined position with the V opening in a position adaptable to receive the heel of the boot for facilitating removal particularly when the other foot of the person wearing the boots presses downwardly against the rear part and with the forces acting downwardly through the leg to maintain the bootjack in extended position. While the structure is designed such that any force applied to the bootjack acts to automatically lock the part against further movement, the spring hinge joint and leg structure is complicated and expensive to manufacture. The leg is in some respects too remote from the V-shaped opening or notch, receiving the heel of the boot to be removed to be effective, and the support system is not sufficiently rugged to withstand physical abuse. Further, no means are provided for insuring that the bootjack will not slide on the surface of the ground or other flat support surface upon which bootjack rests in open or extended position during usage.

SUMMARY OF THE INVENTION

The present invention is directed to a compact, foldable bootjack which comprises an elongated planar front member and an elongated planar rear member, the front and rear members are hinge connected at abutting ends for folding bottom to bottom onto each other and about the hinge connection. A right angle leg member is hinged at its upper end to the bottom of the front member forward of the hinge for movement from a position overlying and against the bottom of the front member to a position generally at right angles thereto with its free end in contact with the underlying support surface for supporting the front and rear members when in extended position inclined upwardly and forwardly. The front member bears a V-shaped opening to receive the heel of the boot to facilitate removal of the boot from the user's foot.

The improvement resides in a leg member locking bar which is pivoted at one end to the leg member intermediate of its ends and adjacent a lower end thereof and at its opposite end to the rear member, rearwardly of the hinge joint such that when the front and rear members are in extended position, the leg member is generally at right angles to the bottom of the front member, and the locking bar extends at right angles to the plane of the leg member to effect a highly rigid triangular support for the open or extended bootjack to resist deformation while facilitating removal of a boot inserted within the V-shaped opening of the front member. Further, during folding of the front and rear members about the hinge axis connecting the same, the front and rear members, the leg member and the locking bar are folded about their hinge axes into generally parallel coplanar positions.

Preferably, both the leg member and the locking bar are bifurcated adjacent the hinge connection between these members to form central openings aligned with the V-shaped opening at the front end of the front member. A rubber bar fixed to the bottom of the rear member at its end remote from the hinge joint to the front member and projecting therefrom acts as a stop or brake when contacting the support surface remote from the leg, and when the bootjack is folded, the rubber bar projects within the aligned openings of the bifurcated locking bar, leg and front member.

BRIEF DESCRIPTION OF THE DRAWINGS

FIG. 1 is a perspective view of the improved compact foldable bootjack of the present invention in extended, use position.

FIG. 2 is a side elevational view of the bootjack of FIG. 1.

FIG. 3 is a bottom plan view of the bootjack of FIGS. 1 and 2.

FIG. 4 is a front elevational view thereof.

FIG. 5 is a side view of the bootjack of FIG. 1 in folded position.

DESCRIPTION OF THE PREFERRED EMBODIMENT

Reference to the drawings illustrates one embodiment of the improved foldable bootjack with positive locking means, indicated generally at 10, and comprising basically two parts: a front member 12 and a rear member 14. Both members are of flat or elongated planar form, preferably of flat sheet metal, and widening from one end towards the other in somewhat trapezoidal fashion. The rear member 14 is provided with a pair of hinge members 28 riveted or welded to the bottom surface 14*a* of that member which are pivotably connected by pins 29, respectively, to corresponding hinge members 30, fixed at opposite edges of the front member 12, and on the bottom surface 12*a* of that member. These define a hinge joint indicated generally at 31 for ends 18 of rear member 14 and 22 of front member 12.

As may be seen in contrasting FIGS. 2 and 5, in extended position, the front and rear members are coplanar, while in folded transport position, the bottom faces 12*a* and 14*a* of the members 12 and 14 face each other, this movement being controlled by the pivoting of the hinge members 28 and 30 of these members about the axis of the pins 29.

Pertinent to the present invention is the provision of a rubber bar as at 70 which is mounted to the bottom face 14*a* of the rear member 14 by means of screws or the like as at 72. The bar 70 includes an inclined or beveled face 70*a* which contacts the support surface S and being formed of rubber, resists sliding movement of the bootjack on the surface S such as a floor or the like when forces are exerted to remove the boot (not shown) of the operator when the heel thereof is inserted within the V-shaped opening 24 at the forward end of the front member 12. The bar 70 forming a stop or brake, is mounted to the rear member 14 adjacent end 16 and extends from generally one side 20 thereof to the other. The sides 20 of the rear member 14 taper outwardly from end 16 towards end 18, while the same is true for sides 26 of the front member 12 which taper outwardly in a forward direction from the end 22 towards the V-shaped opening 24 at the forward end of the front member 14, the opening 24 defined by spread fingers 12*a*.

In the description, the end 18 of member 14 is indicated as being its upper end because when in use the assembly, at least in terms of the coplanar front and rear members, is inclined upwardly from end 16 of the rear member towards the V-shaped opening 24 at the upper end of the front member 14 of this assembly.

As another aspect of the present invention, while it is true that the bootjacks in the past have employed legs which depend downwardly from the bootjack forward of the point where the rear end of that bootjack contacts the floor or surface S, the present invention provides a high strength, triangular support utilizing the front and rear members of the hinged bootjack proper as well as the depending legs to rigidify and lock the pivotable members 12 and 14 into coplanar position. In that respect, the leg which is indicated generally at 36 is also formed of a strip of sheet metal, is bifurcated to define leg portions 36*a* at the bottom which form a central opening 38 between these leg portions, the upper end of the leg 36 being hinge connected to the bottom face 12*a* of the upper member 12. The hinge which is shown generally at 40 comprises hinge plate 42 which is bolted, riveted, etc., to the bottom face 12*a* of member 12. A similar hinge plate 44 is fixed to the upper end of leg 36 and is pin connected by way of hinge pin 46 to plate 42.

A latch yoke or locking bar is formed of a piece of flat sheet metal and includes a central base 50*a* at one end and terminates at its opposite end in bifurcated arms as at 50*b* defining a central opening 51. The lateral width of the arms 50*b* is essentially equal to the width of the bifurcated leg portion 36*a*, and is hinged thereto by way of hinges as at 60. Each of the hinges 60 includes a hinge plate 64 which is riveted or welded to leg portions 36*a* and a hinge plate 62 which is riveted to the bifurcated arms 50*b* of the latch yoke or locking bar 50. Pins 68 connect the hinge plates for pivoting relative to each other. The locking bar at its opposite end is hinge connected by way of hinge plate 54 to the bottom surface 14*a* of the rear part 14 of the bootjack. A pin 55 permits normal hinge pivoting of plate 54 relative to a second plate 56: plate 56 being riveted to the locking bar. It is noted that the hinge 52 formed by these hinge plates, lies just to the rear of the upper end 18 of the rear part 14 and between laterally opposed hinge parts 28 carried by the rear member 14. The location of the hinge 52 and the paired hinges 60 are such as to insure a generally right triangular support for the hinged bootjack, when the parts 12 and 14 are in extended coplanar position.

As may be appreciated by viewing FIGS. 4 and 5, when the bootjack is folded into its compact transport condition, the bar 70 acting as the stop or brake, neatly pivots into a position where it is received within the opening 24 of the front part as well as opening 38 of the leg 36 and opening 51 of the locking bar 50. When one foot is pressed onto the surface of the extended upwardly inclined bootjack as seen in FIG. 1, with pressure exerted on both planar members 12 and 14, this pressure acts to cause the ends 18 of member 14 and 22 of member 12 to press against each other. This force also tends to cause the leg 36 to try to pivot, counterclockwise, FIG. 2, about pin 46, but is restricted by the bar between leg 36 and the bottom member 14. The leg 36 also stabilizes the assembly and transmits the forces acting through the assembly particularly during removal of a boot which is placed within the V-shaped opening 24 at the upper end of the front member 12 of the assembly.

Further, when the bootjack is pivoted to its closed position, as shown in FIG. 5, the latch yoke or locking bar 50 pivots about hinge 52, lies flush against the bottom face 14*a* of the rear member 14 and does not interfere with the movement of the two main members 12 and 14 into opposing bottom face position, as seen in FIG. 5.

As mentioned previously, while the hinges are mounted to respective parts by way of rivets, it may be appreciated that simple brazing or welding techniques may be employed.

While the invention has been particularly shown and described with reference to a preferred embodiment thereof, it will be understood by those skilled in the art that various changes in form and details may be made therein without departing from the spirit and scope of the invention.

What is claimed is:

1. A compact, foldable bootjack including an elongated, planar front member and an elongated planar rear member, means for hinge connecting said front and rear members at abutting ends for folding bottom to bottom onto each other and about the hinge connection, a right angle leg member being hinge connected at its upper end to the bottom of the front member forward of the hinge connection between said members for pivoting from a first position overlying and against the bottom of the front member to a position generally at right angles thereto with its bottom end in contact with an underlying support surface for supporting the front and rear members when in extended position inclined upwardly and forwardly, said front member bearing a V-shaped opening at its end remote from its hinge connection to said rear member to receive the heel of a boot to facilitate removal of the boot from the user's foot, the improvement comprising: a leg member locking bar being pivotably connected at one end to said leg member intermediate of its ends and adjacent the lower end thereof in contact with the support surface and being pivotably connected at its opposite end to said rear member, rearwardly of the hinge joint between said front and rear members such that when the front and rear members are in extended position, the leg member is generally at right angles to the bottom of the front member, and the locking bar extends generally at right angles to the plane of the leg member to form a highly rigid, triangular support for the open, extended bootjack and to resist forces acting through the bootjack during removal of a boot inserted within the V-shaped opening of the front member, and wherein during folding of the bootjack front and rear members about the hinge axis connecting the same, the front and rear members, the leg member and the locking bar are all folded about their hinge axes into generally parallel coplanar position.

2. The bootjack as claimed in claim 1, wherein said leg member and said locking bar are bifurcated adjacent the hinge connection between these members to form central openings aligned with the V-shaped opening at the front end of the front member and a rubber bar is fixed to the bottom of the rear member at its end remote from the hinge connection between said front and rear members and projects downwardly therefrom to act as a stop or brake when contacting the support surface at a point remote from contact between said leg and said support surface, and wherein; when said bootjack is folded, said rubber bar projects within the aligned openings of the bifurcated locking bar, leg and front member to maximize compact hinge folding of said bootjack components.

* * * * *